US006439935B2

(12) United States Patent
Saka et al.

(10) Patent No.: US 6,439,935 B2
(45) Date of Patent: Aug. 27, 2002

(54) FEMALE TERMINAL FITTING

(75) Inventors: Yukinori Saka; Koji Okutani, both of Yokkaichi (JP)

(73) Assignee: Sumitomo Wiring Systems, Ltd., Mie (JP)

( * ) Notice: Subject to any disclaimer, the term of this patent is extended or adjusted under 35 U.S.C. 154(b) by 0 days.

(21) Appl. No.: 09/862,447

(22) Filed: May 23, 2001

(30) Foreign Application Priority Data

Jun. 5, 2000 (JP) ..... 2000-167814

(51) Int. Cl.[7] ..... H01R 11/22

(52) U.S. Cl. ..... 439/852; 439/849; 439/856; 439/851; 439/842

(58) Field of Search ..... 439/839, 842, 439/843, 845, 847, 849, 850, 851, 852, 856, 857, 858, 862, 861

(56) References Cited

U.S. PATENT DOCUMENTS 3,409,867 A * 11/1968 Lessner ..... 439/849
5,599,212 A 2/1997 Sawada ..... 439/843
5,607,328 A * 3/1997 Joly ..... 439/852
5,695,368 A * 12/1997 Joly et al. ..... 439/839
5,868,590 A * 2/1999 Dobbelaere ..... 439/839
6,042,433 A * 3/2000 Chen ..... 439/852
6,203,385 B1 * 3/2001 Sato et al. ..... 439/852

FOREIGN PATENT DOCUMENTS

EP 0633625 A2 * 11/1995 ..... 439/852
JP 5-62729 * 3/1993 ..... 439/842

* cited by examiner

*Primary Examiner*—Tho D. Ta
(74) *Attorney, Agent, or Firm*—Banner & Witcoff, Ltd.

(57) ABSTRACT

The invention provides a miniaturized female terminal fitting. A female terminal fitting 10 has resilient contacts 16 within a cover 20. When a male tab 30 is inserted into the cover 20, the resilient contacts 16 bend outwards as they make contact therewith. Side walls 21 have recessed members 25 formed therein, the resilient contacts 16 being capable of entering these recessed members 25. Due to these recessed members 25, at least a portion of the bending space for the resilient contacts 16 is provided within the wall thickness of the side walls 21 of the cover 20. Consequently, the side walls 21 can be positioned further inwards by a distance corresponding to the dimensions gained by locating the bending space within the side walls 21.

20 Claims, 5 Drawing Sheets

FEMALE TERMINAL FITTING

TECHNICAL FIELD

This invention relates to a female electrical terminal provided with resilient contacts.

BACKGROUND TO THE INVENTION

One example of a female terminal fitting provided with resilient contacts is described in U.S. Pat. No. 5,599,212. This female terminal fitting comprises a main body provided with an electric wire contacting member and resilient contacts, and a cover which is attached to the main body so as to cover the resilient contacts. A tab of a male terminal fitting is inserted into the cover, and the resilient contacts bend towards side walls of the cover while making contact with the tab.

In cases like the example described above in which the resilient contacts are surrounded by the cover, space is required at the outer sides of the resilient contacts to allow these resilient contacts to bend. Furthermore, additional space is required at the outer sides of this space, this additional space corresponding to the wall thickness of side walls of the cover. As a result, the female terminal fitting has to be wide. The present invention has taken the above problem into consideration, and aims to present a miniaturized female terminal fitting provided with resilient contacts.

SUMMARY OF THE INVENTION

According to the invention there is provided a female terminal fitting comprising a hollow body having a peripheral wall and including a resilient electrical contact therein for contact with a male terminal fitting, said contact being bendable outwardly of the body on insertion of a male terminal fitting, wherein said body includes a recess in said wall to accommodate outward movement of said contact.

Such a terminal fitting provides a recess in the wall thickness of the body. Thus the overall size of the fitting may be reduced for a given configuration of resilient contact. The saving in width corresponds to the bending space previously provided between the inner wall of the body and the resilient contact.

Preferably the recess is an aperture, thus permitting the entire wall thickness to be utilized. In the case of two parallel contacts between which a male terminal is inserted, the width saving is doubled, thus permitting a considerable miniaturization of terminal width.

BRIEF DESCRIPTION OF DRAWINGS

Other features of the invention will be apparent from the following description of preferred embodiments shown by way of example only in the accompanying drawings in which.

DESCRIPTION OF PREFERRED EMBODIMENTS

Figure 1:
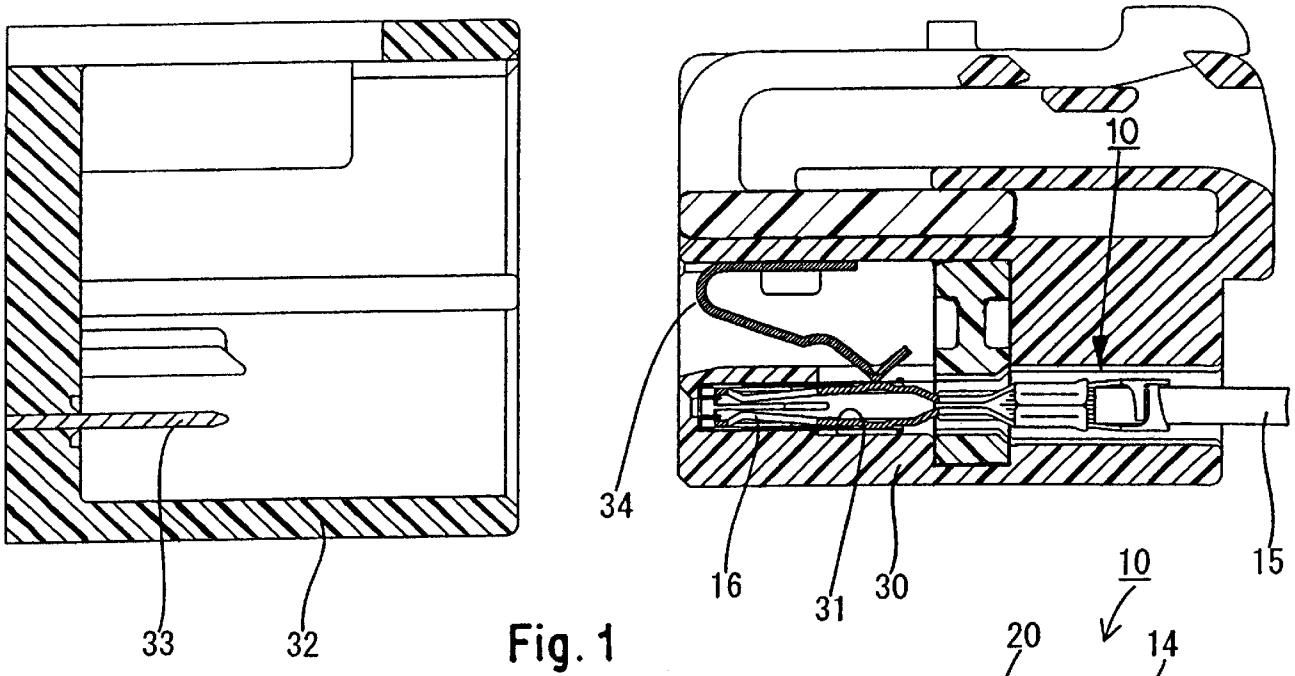
FIG. 1 is a cross-sectional view of a female housing having a female terminal fitting of a first Embodiment attached thereto, and of a corresponding male housing.
Figure 2:
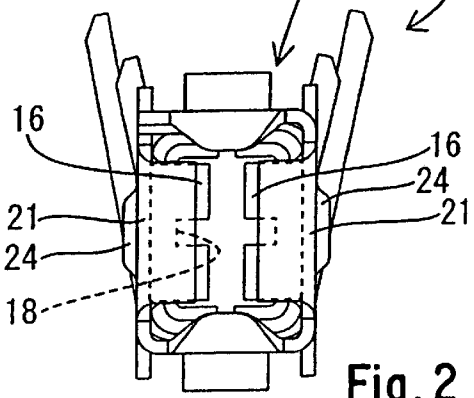
FIG. 2 is a front view showing the female terminal fitting of FIG. 1.
Figure 3:
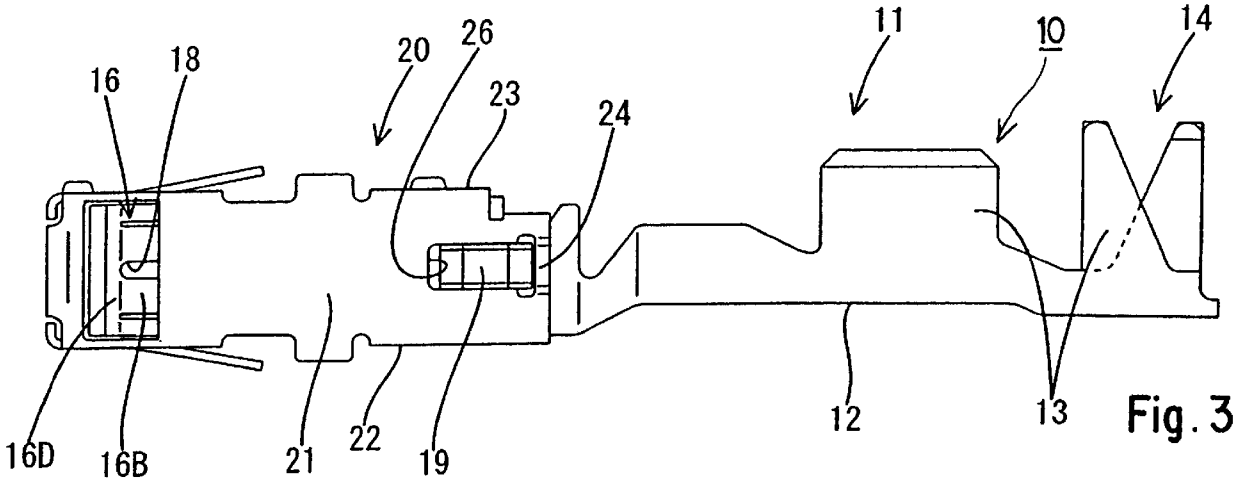
FIG. 3 is a side face view of the female terminal fitting of FIG. 1.
Figure 4:
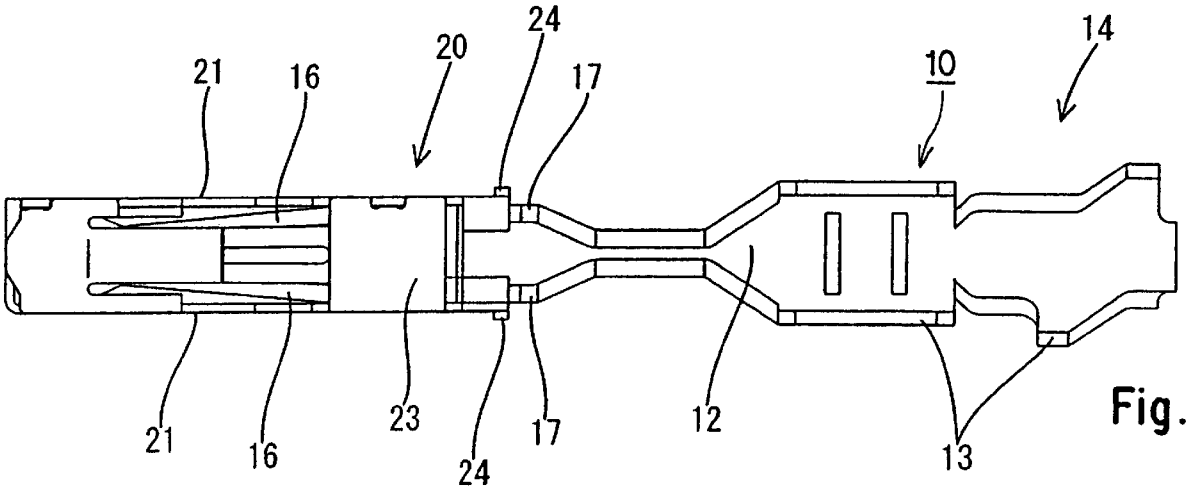
FIG. 4 is a plan view of the female terminal fitting of FIG. 1.
Figure 5:
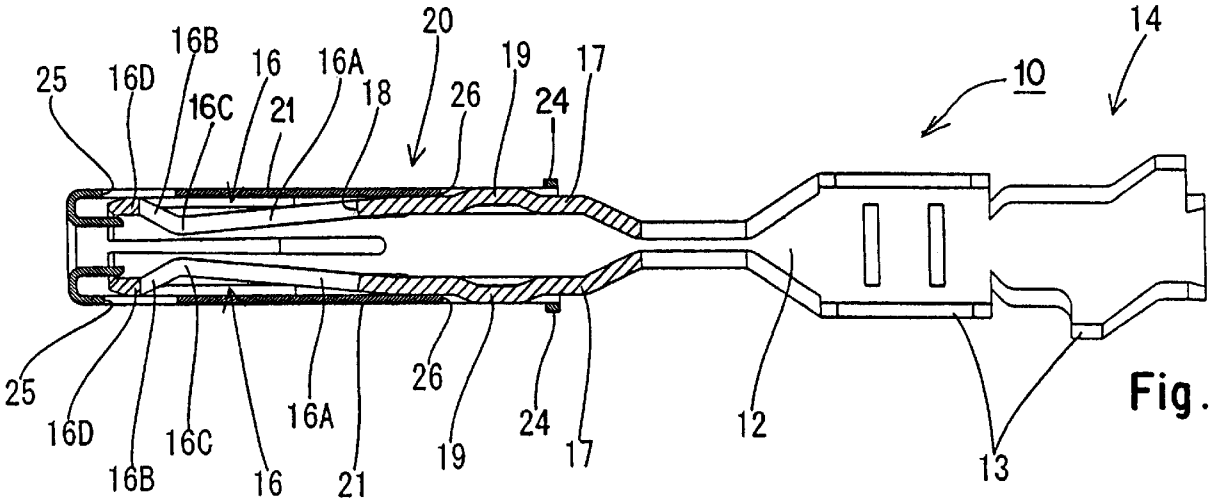
FIG. 5 is a partially cut-away plan view of the female terminal fitting of FIG. 1.
Figure 6:
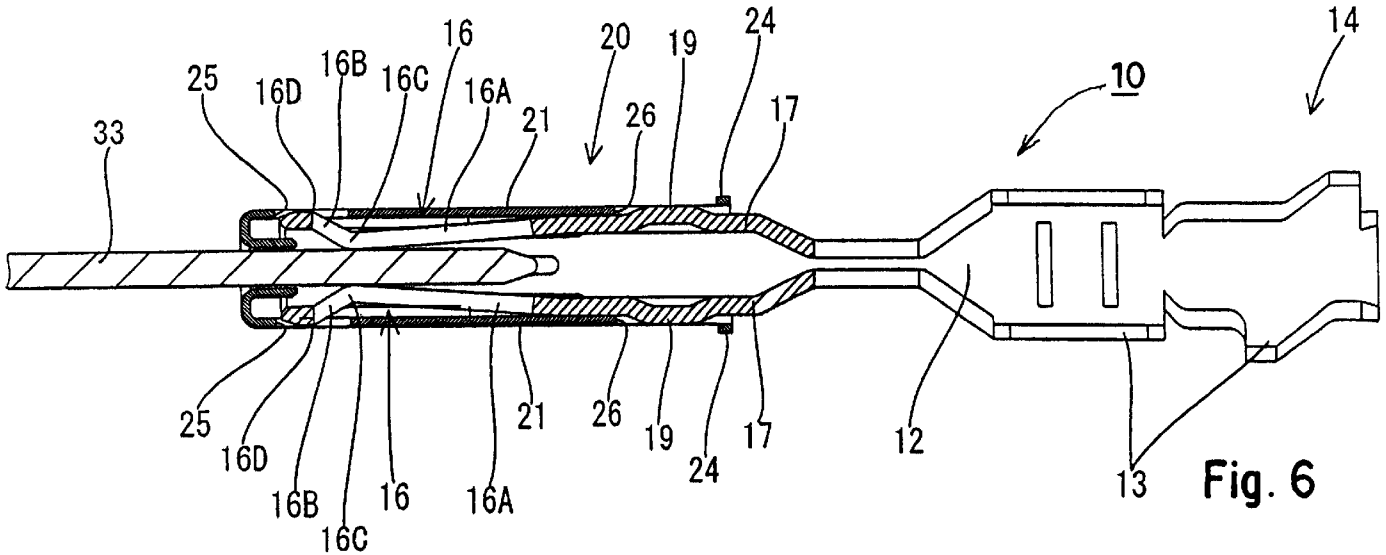
FIG. 6 is a partially cut-away plan view of the female terminal fitting of FIG. 1, the female terminal fitting having a male tab in an inserted state therein.

A first embodiment of the present invention is described below with the aid of FIGS. 1 to 6.

A female terminal fitting 10 of the present embodiment is housed within a cavity 31 of a female housing 30. When this female housing 30 is fitted to a male housing 32, a male tab 33 of the male housing 32 enters the cavity 31 and makes contact with the female terminal fitting 10. A main body 11 and a cover 20 of the female terminal fitting 10 are formed as mutually separate components, and are then joined together.

The main body 11 is formed from an electrically conductive metal sheet that is stamped out in a specified shape and then bent. This main body 11 is long and narrow in an anterior-posterior direction (the inserting direction of the male tab 33). An open barrel electric wire crimping member 14, which is formed in approximately the posterior half of the main body 11, has a base wall 12 and crimping members 13 that rise upwards from both side edges of the base wall 12. An electric wire 15 is crimped to this electric wire crimping member 14. Resilient contacts 16 are formed at an anterior half of the main body 11. These resilient contacts 16 make contact with the male tab 33. The resilient contacts 16 are formed as a left and right symmetrical pair that extend towards the anterior from supporting wall members 17 positioned at a central (relative to the anterior-posterior direction) location of the main body 11. A long and narrow slit, which extends in an anterior-posterior direction, is formed in each resilient contact 16. When each resilient contact 16 is viewed from above, the following components thereof are visible: a longer base member 16A that is approximately straight and inclines slightly inwards towards the anterior; and a short bent end 16B that inclines outwards from an anterior end of the base member 16A. The portion where each base member 16A and bent end 16B meet forms a contacting member 16C that is bent at an obtuse angle and makes contact with the male tab 33. The bent end 16B bends outwards from this contacting member 16C. The resilient contacts 16 are capable of resiliently bending outwards, a posterior end of the base members 16A serving as a fulcrum, and the bent ends 16B and the contacting members 16C opening wider. When the left and right contacting members 16C are in a free state (that is, in a state whereby they do not make contact with the male tab 33) the space therebetween in a left-right direction is less than the thickness, in a left-right direction, of the male tab 33. Furthermore, a portion of each supporting wall member 17 is embossed to form outwardly-protruding short-circuiting contacts 19. A short-circuiting terminal 34, which is provided on the female housing 30, makes contact with one or other of these short-circuiting contacts 19.

The cover 20 is formed by bending sheet metal (which may be conducting or non-conducting) which has been punched out in a specified shape. This cover 20 has a long and narrow angular tubular shape in an anterior-posterior direction (that is, the inserting direction of the male tab 33). The cover 20 is attached from its anterior end to the main body 11, in a manner so as to cover the exterior thereof. Inner faces of left and right side walls 21 of the cover 20 make contact with outer faces of the supporting wall members 17 of the main body 11, thereby preventing the cover 20 from rattling to the right or left relative to the main body 11. A lower face of the base wall 12 of the main body 11 and upper edges of the supporting wall members 17 make contact with a lower face wall 22 and an upper face wall 23 of the cover 20, thereby preventing the cover 20 from rattling in an up-down direction relative to the main body 11. Posterior end portions of the side walls 21 have window holes 26 formed therein. These allow the short-circuiting terminal 34 and the short-circuiting contacts 19 to make contact. Furthermore, protruding members 24 that extend outwards are formed by pressing along portions of posterior hole edges of the window holes 26. These protruding members 24 prevent the cover 20 from interfering with the short-circuiting contacts 19 of the main body 11 when the cover 20 is being attached to the main body 11.

When the main body 11 and the cover 20 are in an attached state, the resilient contacts 16 are in a free state (that is, in a non-contacting state with the male tab 33). Only the posterior ends of the base members 16A (these serving as the bending fulcrum when the resilient contacts 16 are bent) make contact with the side walls 21 of the cover 20. Moreover, approximately the entirety of the base members 16A and the bent ends 16B are located inwards relative to the side walls 21. Outer faces of bending sections 16D of the bent ends 16B are provided at the same location (in the left-right direction) as inner faces of the side walls 21. Other portions of the bent ends 16B are located inwards relative to the side walls 21.

The resilient contacts 16 bend outwards when they make contact with the male tab 33, and the bent ends 16B thereof move outwards. However, since the outer faces of the 20 bending sections 16D of the bent ends 16B are provided at the same location as the inner faces of the side walls 21 of the cover 20, there is no bending space for the resilient contacts 16. For this reason, in the present embodiment, recesses 25 are formed in the side walls 21. These recesses 25 are square, have an area corresponding to the bent ends 16B of the resilient contacts 16, and pass from the inner faces of the side walls 21 through to outer faces thereof. When the male tab 33 is inserted between the two resilient contacts 16, thereby pushing these resilient contacts 16 outwards, the bent ends 16B enter the recesses 25. Consequently, these bent ends 16B do not interfere with the side walls 21. That is, the recesses 25 constitute bending spaces that allow the resilient contacts 16 to bend resiliently.

In the embodiment described above, the recesses 25 are provided in the side walls 21; they have an area that corresponds to the bent ends 16B of the resilient contacts 16, and function as bending spaces for the resilient contacts 16. Consequently, at least a portion of the bending space for the resilient contacts 16 is provided within the wall thickness of the side walls 21 of the cover 20. Furthermore, these recesses 25 are not formed as grooves within the inner faces of the side walls 21, but instead pass through these side walls 21 from the inner faces to the outer faces thereof. As a result, the entire wall thickness of the side walls 21 is utilized to provide the bending space for the resilient contacts 16. In contrast to the case wherein the bending space for the resilient contacts 16 is provided as additional space within a location inwards relative to the inner faces of the side walls 21, the present configuration utilizes only the wall thickness of the side walls 21 for this bending space. Consequently, these side walls 21 can be located further inwards, and the left-right dimensions of the female terminal fitting 10 can be reduced.

Figure 7:
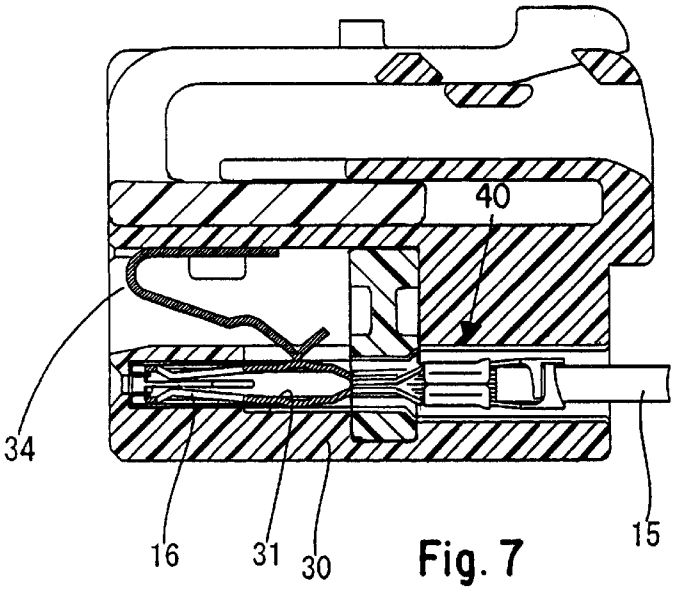
FIG. 7 is a cross-sectional view of a female housing of a second embodiment, the female housing having a female terminal fitting of a second embodiment attached thereto.
Figure 8:
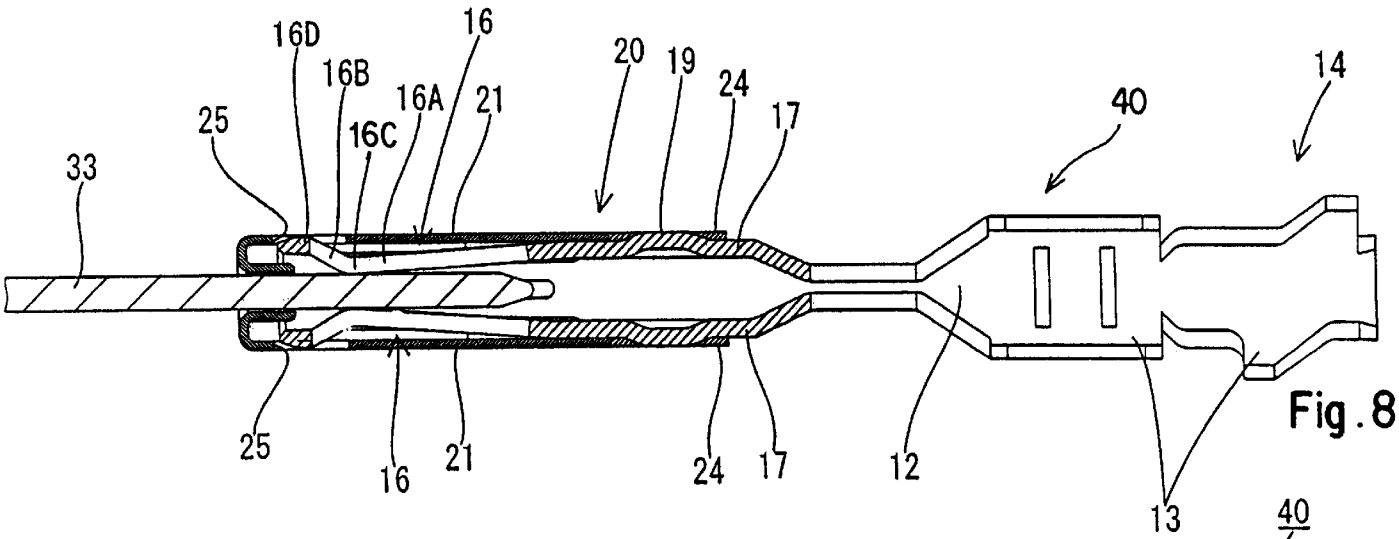
FIG. 8 is a partially cut-away plan view of the female terminal fitting of FIG. 7, the female terminal fitting having a male tab in an inserted state therein.

A second embodiment of the present invention is described below with the aid of FIGS. 7 to 9.

A female terminal fitting 40 of Embodiment 2 has a configuration whereby a portion of the cover 20 thereof is shaped differently from that of Embodiment 1. The remaining configuration is the same as Embodiment 1 and accordingly the same symbols are used and an explanation of the structure, operation and effects thereof is omitted.

In Embodiment 1, the protruding members 24 protrude outwards at the posterior end of the cover 20, thereby preventing the cover 20 from interfering with the short-circuiting contacts 19 of the main body 11 when this cover 20 is being attached. In this embodiment, after the cover 20 has been attached, a pressing operation or the like is performed from the exterior on the protruding members 24 of the cover 20, thereby causing the outer faces of these protruding members 24 to form a unified face with the outer faces of side walls 21.

Figure 10:
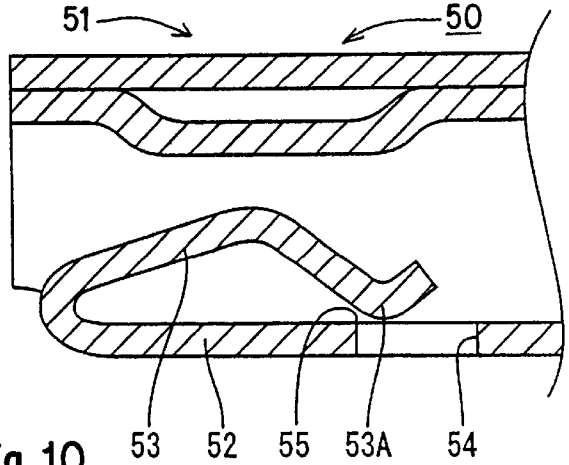
FIG. 10 is a partial cross-sectional view of a female terminal fitting of a third embodiment.
Figure 11:
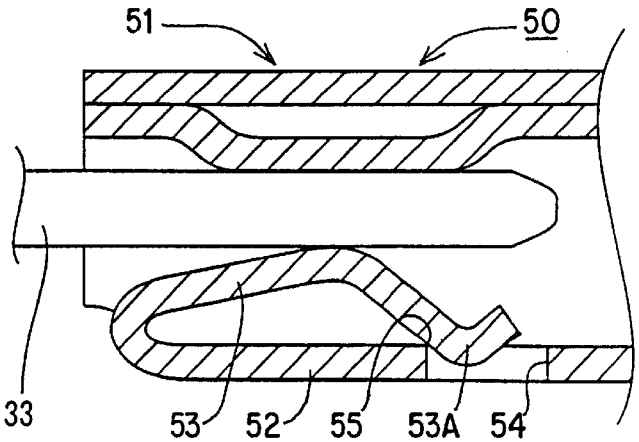
FIG. 11 is a partial cross-sectional view of the female terminal fitting of FIG. 10, the female terminal fitting having a male tab in an inserted state therein.

A third embodiment of the present invention is described below with the aid of FIGS. 10 and 11. The female terminal fittings 10 and 40 of Embodiments 1 and 2 are configured such that the main body 11 and the cover 20 are formed as two separate components that are later joined together. By contrast, in this embodiment, a female terminal fitting 50 is formed as a single component. That is, a base wall 52 comprises a cover 51 which has been bent into an angular tubular shape. A resilient contact 53, which has a bent-over shape, joins with an anterior end of this base wall 52. A recess 54, into which a tip 53A of the resilient contact 53 can enter, is formed in the base wall 52. This recess 54 passes through the base wall from an inner face to the outer face thereof. An inner face hole edge of the recess 54 forms an excessive-bending regulating member 55.

When a male tab 33 is inserted, the tip 53A of the resilient contact 53 is moved outwards from the interior of the base wall 52, and enters the recess 54. An outer face of the tip 53A of the resilient contact 53 makes contact with the excessive-bending regulating member 55, thereby preventing the resilient contact 53 from bending beyond its limit of elasticity.

Figure 9:
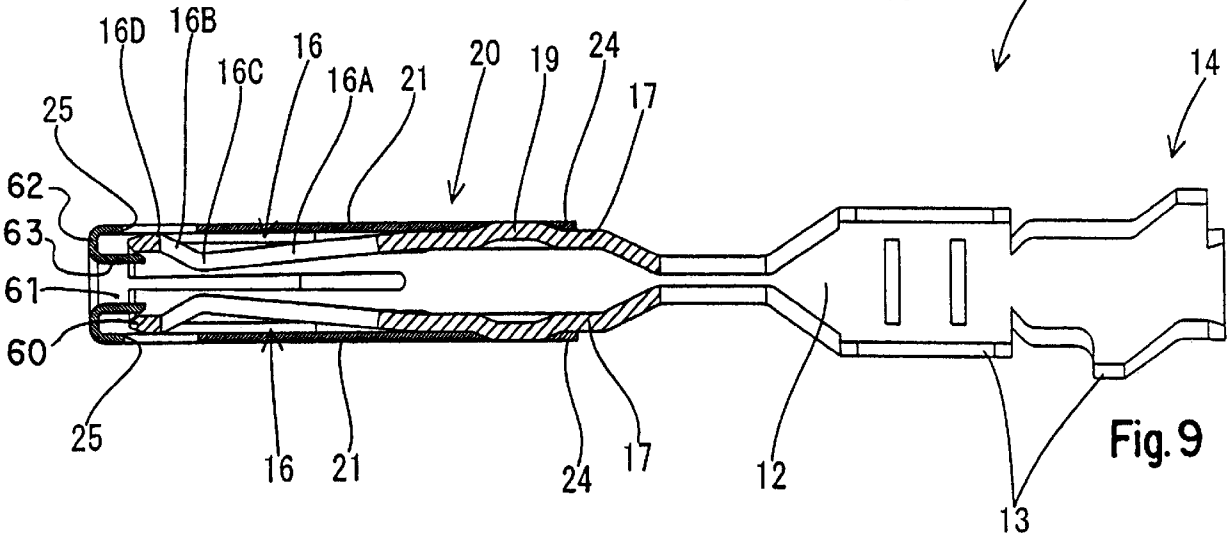
FIG. 9 is a partially cut-away plan view of the female terminal fitting of FIG. 7.

As illustrated for example in FIG.9, the resilient electrical contact 16 is cantilevered, and has a free end 60 (the left end as viewed). The corresponding body 20 defines an aperture 61 to receive the male terminal 33. This aperture 61 is defined by bending the outer wall of the body 20 inwardly so as to have a transverse portion 62 and a free end 63 which faces towards the contact 16. These portions 62,63 have the additional advantage that they substantially enclose the free end of the contact 16 and protect it from damage due to external contact or misaligned male terminal. Excessive inward movement of the contact 16 is also prevented by contact of the free end 60 with the free end 63 of the body. The precise shape of the end of the body is not important provided that the free end of the resilient contact is substantially enclosed to prevent inadvertent damage thereof.

The remaining configuration is the same as Embodiment 1 and accordingly an explanation of the structure, operation and effects thereof is omitted.

The present invention is not limited to the embodiments described above with the aid of figures. For example, the possibilities described below also lie within the technical range of the present invention. In addition, the present invention may be embodied in various other ways without deviating from the scope thereof.

(1) In the embodiments described above, the recesses pass through from the inner faces to the outer faces of the side walls. However, according to the present invention, the recesses may be formed in a concave manner in the inner faces of the side walls without passing through to the outer faces thereof.

What is claimed is:

1. A female terminal fitting comprising a body and a separate cover, said body including a first electrical contact formed of a resilient, conducting material and positioned to engage a male terminal fitting upon insertion of the male terminal fitting in said cover, said first electrical contact bending outward toward a peripheral wall of said cover upon engaging the male terminal fitting, said cover enclosing at least a portion of said body and defining a first recess in said peripheral wall, said first electrical contact including a free end that is substantially parallel to said peripheral wall, said first recess receiving at least said free end to accommodate the outward bending of said first electrical contact.

2. The female terminal fitting according to claim 1, wherein said first recess is an aperture.

3. The female terminal fitting according to claim 1, wherein said cover substantially encloses said free end and separates at least a portion of said free end from the male terminal fitting.

4. The female terminal fitting according to claim 1, wherein said body includes a second electrical contact, said first electrical contact and said second electrical contact being bendable apart on insertion of the male terminal fitting, and said cover having a second recess positioned to receive at least a portion of said second electrical contact when bent by the male terminal fitting.

5. The female terminal fitting according to claim 4, wherein said first electrical contact and said second electrical contact comprise two arms that successively converge from a base end to form a pair of contact regions for engaging the male terminal fitting, and said first contact diverging from a first of said contact regions toward said first recess, and said second contact diverging from a second of said contact regions toward said second recess.

6. A female terminal fitting comprising a body and a separate cover, said body including a first electrical contact formed of a resilient, conducting material and positioned to engage a male terminal fitting upon insertion of the male terminal fitting in said cover, said first electrical contact bending outward toward a peripheral wall of said cover upon engaging the male terminal fitting, said cover enclosing at least a portion of said body and defining a first recess in said peripheral wall, said first recess receiving said first electrical contact to accommodate the outward bending of said first electrical contact, and said first electrical contact including a first free end located proximal a portion of said cover where the male terminal fitting is inserted, said portion of said cover separating said first free end from said male terminal fitting to prevent the male terminal fitting from contacting said first free end.

7. The female terminal fitting according to claim 6, wherein said first recess is an aperture.

8. The female terminal fitting according to claim 6, wherein said body includes a second electrical contact, said first electrical contact and said second electrical contact being bendable apart on insertion of the male terminal fitting, and said cover having a second recess positioned to receive said second electrical contact when bent by the male terminal fitting.

9. The female terminal fitting according to claim 8, wherein said first electrical contact and said second electrical contact comprise two arms that successively converge from a base end to form a pair of contact regions for engaging the male terminal fitting, and said first contact diverging from a first of said contact regions toward said first recess, and said second contact diverging from a second of said contact regions toward said second recess.

10. The female terminal fitting according to claim 8, wherein an edge of said first recess comprises a first abutment to prevent excessive bending of said first electrical contact, and an edge of said second recess comprises a second abutment to prevent excessive bending of said second electrical contact.

11. The female terminal fitting according to claim 8, wherein said second electrical contact includes a second free end, said cover substantially enclosing said second free end and separating at least a portion of said second free end from the male terminal fitting.

12. The female terminal fitting according to claim 11, wherein said first free end and said second free end are substantially parallel to said peripheral wall.

13. A female terminal fitting comprising a body and a separate cover, said body including a first electrical contact formed of a resilient, conducting material and positioned to engage a male terminal fitting upon insertion of the male terminal fitting in said cover, said first electrical contact bending outward toward a peripheral wall of said cover upon engaging the male terminal fitting, said cover enclosing at least a portion of said body and defining a first recess in said peripheral wall, said first recess receiving said first electrical contact to accommodate the outward bending of said first electrical contact, and said first electrical contact including a first slit that extends along at least a portion of a longitudinal length of said first electrical contact, said first slit receiving an edge of the male terminal fitting upon insertion of the male terminal fitting and guiding the male terminal fitting into the female terminal fitting.

14. The female terminal fitting according to claim 13, wherein said first recess is an aperture.

15. The female terminal fitting according to claim 13, wherein said first electrical contact includes a free end, said cover substantially enclosing said free end and separating at least a portion of said free end from the male terminal fitting.

16. The female terminal fitting according to claim 13, wherein an edge of said first recess comprises an abutment to prevent excessive bending of said first electrical contact.

17. The female terminal fitting according to claim 13, wherein said body includes a second electrical contact, said first electrical contact and said second electrical contact being bendable apart on insertion of the male terminal fitting, and said cover having a second recess positioned to receive said second electrical contact when bent by the male terminal fitting.

18. The female terminal fitting according to claim 17, wherein said first electrical contact and said second electrical contact comprise two arms that successively converge from a base end to form a pair of contact regions for engaging the male terminal fitting, and said first contact diverging from a first of said contact regions toward said first recess, and said second contact diverging from a second of said contact regions toward said second recess.

19. The female terminal fitting according to claim 17, wherein an edge of said first recess comprises a first abutment to prevent excessive bending of said first electrical contact, and an edge of said second recess comprises a second abutment to prevent excessive bending of said second electrical contact.

20. The female terminal fitting according to claim 17, wherein said second electrical contact includes a second slit that extends along at least a portion of a longitudinal length of said second electrical contact.

* * * * *